US005573228A

United States Patent [19]

Chestnut

[11] Patent Number: 5,573,228

[45] Date of Patent: Nov. 12, 1996

[54] MITER CLAMP

[76] Inventor: William J. Chestnut, 44 Pickwick St., Fairfield, Conn. 06430

[21] Appl. No.: 370,610

[22] Filed: Jan. 10, 1995

[51] Int. Cl.[6] ..... B25B 1/20

[52] U.S. Cl. ..... 269/41

[58] Field of Search ..... 269/41, 42, 237–239, 269/53, 153, 155, 235, 236, 229

[56] References Cited

U.S. PATENT DOCUMENTS

| | | | |
|---|---|---|---|
| 299,776 | 6/1884 | Giraud | 269/236 |
| 879,547 | 2/1908 | Holter | 269/42 |
| 1,850,695 | 3/1932 | Scott | 269/42 |
| 2,660,141 | 11/1953 | Thomas | 269/41 |
| 4,236,703 | 12/1980 | Stevenson | 269/41 |
| 4,805,888 | 2/1989 | Bishop | 269/235 |

*Primary Examiner*—Robert C. Watson
*Attorney, Agent, or Firm*—Frank J. Thompson

[57] ABSTRACT

An improved miter joint damp is provided in which actuation of workpiece gripping members is effected by a manually actuated member which extends transversely to the plane of the clamp thus facilitating its placement and use.

12 Claims, 3 Drawing Sheets

MITER CLAMP

BACKGROUND OF THE INVENTION

1. Field Of The Invention

This invention relates to clamps for securing mitered workpieces during a fabrication procedure. The invention relates more particularly to an improved miter clamp for securing mitered joints of fine wood trim workpieces during a finish trim procedure.

2. Description Of The Prior Art

On-site miter joint fine finishing generally involves initially positioning finish wood trim workpieces having miter cuts in place at a location where they are to be installed. An example of one such procedure is the installation of fine trim molding at an entrance way or door jamb. Such workpieces have a principal planar surface greater in length than the width of the workpiece and substantially greater in length than the thickness of the workpiece. Fine trim finishing generally provides for gluing together the miter cuts of the work pieces. This requires that the workpieces be maintained in relatively close assembly and accurate alignment after placement of the glue and as the glue cures. Miter clamps have previously been used for this purpose but have suffered from one or more deficiencies in use. In an on-site procedure, the finish trim workpieces are placed against a wall or door jam surface to which they are to be permanently mounted. The miter joint is therefore positioned adjacent tie and in contact with a mounting surface and, at times, close to other surfaces, as for example a ceiling surface. These relatively close space restrictions render it difficult to place and use prior miter joint clamps. Such prior art miter clamps include a clamp actuating means which provides for the application of a manual force to an edge of the clamp. In this type of clamp an adjusting arm extends in a direction generally parallel to the principal plane of the workpieces. One such clamp has been marketed by the Hartford Clamp Company of Hartford, Connecticut. In the relatively confined space in which such a clamp is being mounted, adjustment of this clamp can be either restricted or prohibited by other relatively closely positioned structural surfaces such as a wall and ceiling. Its utility is thereby limited.

Another form of clamp as described in U.S. Pat. No. 3,278,177 to W. B. Zern provides an actuating lever arm extending in a direction normal to the principal plane of the workpiece and applies a clamping force in a direction normal to the principal plane of the workpieces. This requires an extension of the workpiece beyond the mounting structure, a need which cannot be satisfied in many trim finishing procedures. Since the edge is close to the mounting surface, an adequate adjustment can only be provided with great difficulty in the relative close space available for the adjustment. Failure to properly mount the miter clamp often results in out of line or improperly aligned joints.

It is also desirable to gradually increase the clamping force applied to the workpiece, pause to remove excess glue expelled from the miter joint and continue to increase the application of force to its final level while maintaining the desired alignment. Another desirable characteristic of such a clamp is to be able to accommodate workpieces of relatively smaller and larger widths while also maintaining the desired alignment.

SUMMARY OF THE INVENTION

Accordingly, it is an object of this invention to provide an improved miter joint clamp.

Another object is to provide an improved clamp for holding mitered wood trim together under sufficient pressure to form a glue joint.

Another object of the invention is to provide an improved clamp having an actuating means which effects a smooth, controlled application of force to a miter joint, which maintains the force at an intermediate level less than full force to enable the removal of glue expelled from the joint under this intermediate force as well permitting adjustments to the miter face alignment before full clamping force is applied.

Another object of the invention is to .provide an improved clamp having a rigid casing structure which remains substantially stationery as the clamp is actuated thereby effecting a stable support for the clamping means and a stable support for accurate repositioning of the wood members being clamped.

Another object of the invention is to provide an improved clamp having an actuating member extending transversely to a principal plane of the workpiece which enables both clamped workpieces and mounting surface to be maintained in contact as the clamping is effected.

Another object of the invention is to provide an improved clamp which eliminates the use of projections on the mounting surface of the workpiece so that workpieces having been clamped car/then be permanently installed to a mounting surface with the clamp still in place.

Another object of the invention is to provide an improved clamp having an actuating member spaced from the clamp by a distance sufficient for enabling a closed hand to manually operate the clamp without contacting other clamp members thus permitting the operator to adjust the workpiece position with another hand while holding a workpiece with another hand.

Another object of the invention is to provide an improved clamp having a pivoted clamp member and means for adjusting the pivot point for equalizing clamping pressure along the length of the mitered joint for workpieces of different widths.

Another object of the invention is to provide an improved clamp having workpiece gripping teeth which can be readily adjusted in height and removed and replaced.

Still another object of the invention is to provide a clamp assembly wherein a clamp actuator may be oriented for a left hand or fight hand location.

A further object of the invention is to provide an improved clamp which provides a readily visible indication that clamp gripping members are fully opened to receive another workpiece.

In accordance with features of this invention, a miter joint clamp assembly, comprises first and second elongated clamp members which engage first and second workpieces respectively, each workpiece having a miter cut segment formed therein. A support means is provided for mounting the first and second clamp members in an assembly for receiving and maintaining the miter cut segments of the first and second workpieces in engagement between the clamp members. The support means includes a pivot means which enables rotary motion of at least one of said clamp members relative to the other member in a first plane, generally parallel to a principal plane of the workpieces. An actuating means, including an actuating member extending transverse to the first plane for manually applying a rotary force to one of the clamp members causes rotary movement of said clamp members toward each other and the application of a clamping force to edges of the workpieces.

BRIEF DESCRIPTION OF THE DRAWINGS

These and other objects and features of the invention will become apparent from the following specification and from the drawings wherein.

DETAILED DESCRIPTION

Figure 4:
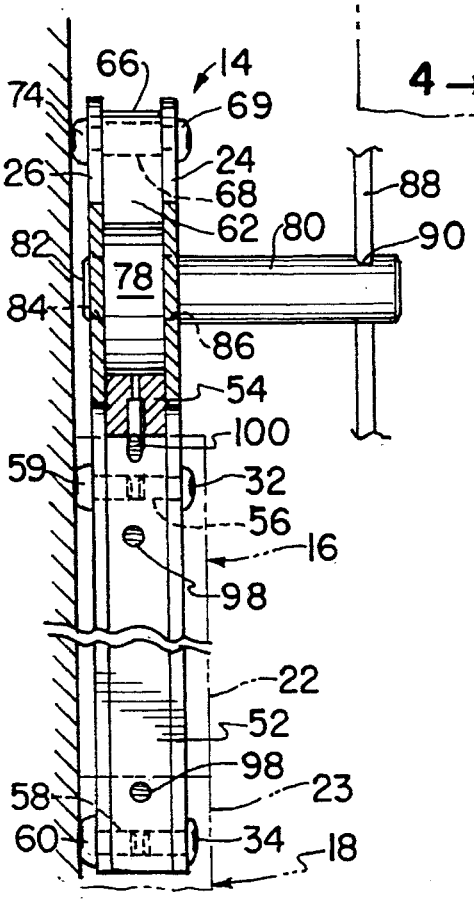
FIG. 4 is a view taken along line 4—4 of FIG. 3.
Figure 5:
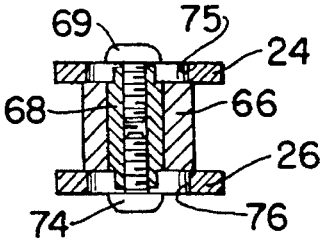
FIG. 5 is an enlarged view taken along line 5—5 of FIG. 3.

Referring now to the drawings, a miter joint clamp assembly 14 is illustrated for gripping workpieces 16 and 18 each having miter cuts 17 and 19 respectively extending through their thickness 20 and 21 respectively. The workpieces have, and extend in, a principal plane which includes their principal surfaces 22 and 23. Clamp assembly 14 includes a support means formed by first and second metal plates 24, 26 which are secured in rigid alignment by machine screws 28, 30, 32, and 34 extending through apertures in the plate 24. Screws 28 and 30 engage internally threaded stand offs 40 and 42, respectively. Similar machine screws, not shown, extend through apertures in plate 26 and into and engage the threaded standoffs 40 and 42. Positioned between the plates 24, 26 are a first elongated workpiece gripping member 52 and a second elongated workpiece gripping member 54, at least one of which can be rotated relative to the other. More particularly, gripping member 52 is rectilinear shaped and is fixedly mounted between plates 24 and 26 by the machine screws 32 and 34 which extend into threaded bores 56, 58 in the member 52. Similarly, screws 59 and 60 (FIG. 4) extend through apertures in the plate 26 and engage the threaded bores 56 and 58 respectively. The member 54 includes an integrally formed rectilinear segment 61 and an integrally formed segment 62 which extends at an angle to the segment 61. Segment 62 includes a bore formed in a distal end 66 thereof and a pivot means is provided for enabling rotary motion of the member 54 toward and away from the member 52. The pivot means comprises an internally threaded stand off 68 (FIG. 5) positioned in the bore of segment 62, a screw 69 extending into and engaging the threaded stand off 68 and a similar screw 74 extending into the threaded bore of the stand off from the opposite plate 26. Stand off 68 which is positioned in the bore of member 54 operates as a pivot about which the member 54 can rotate. The pivot location of the stand off 68 can be varied in practice by relatively small amounts by virtue of a slot 75 in plate 24 (FIGS. 3 and 5) and slot 76 in plate 26 (FIG. 5) through which it extends.

Figure 2:
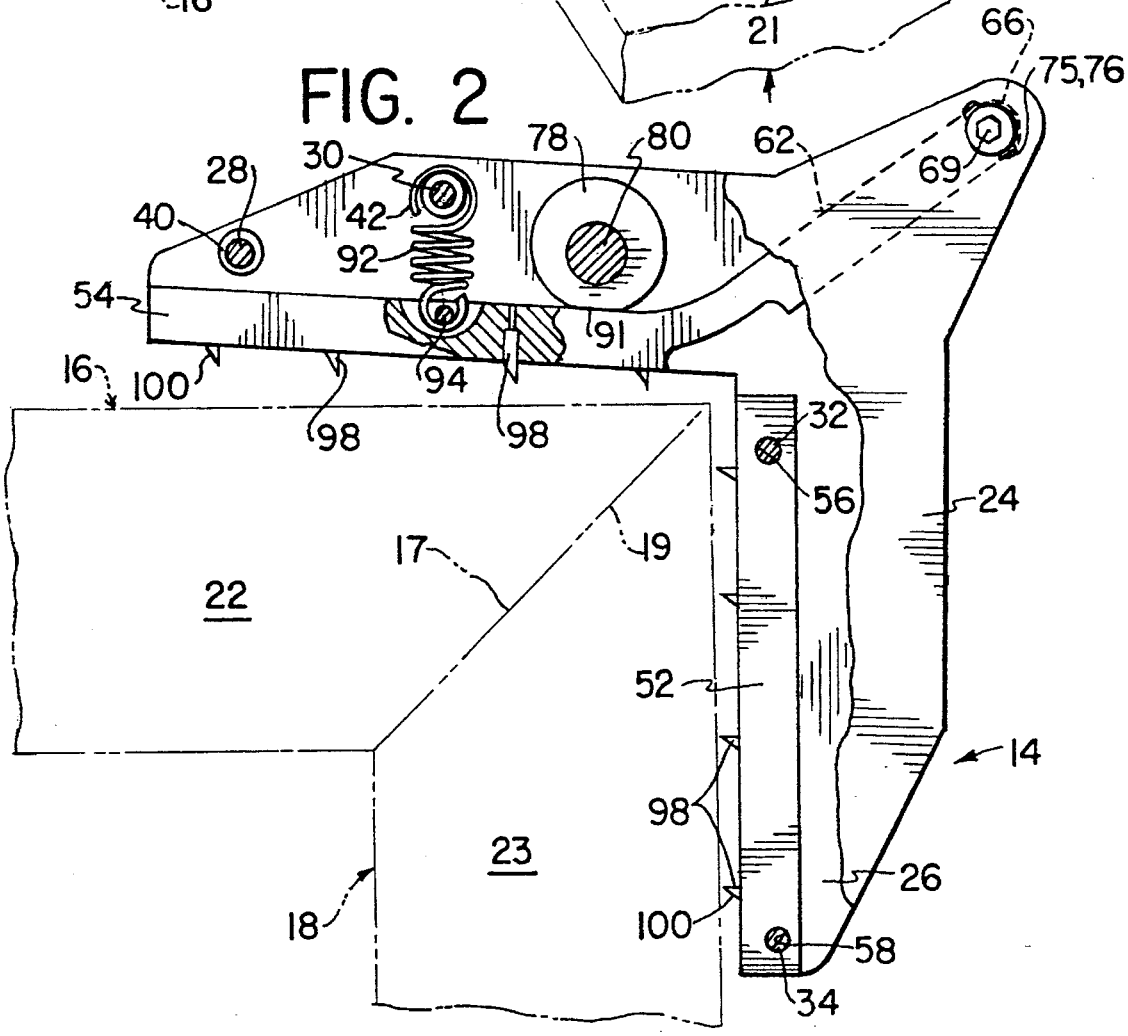
FIG. 2 is a top plan view of the miter clamp of FIG. 1, partly cut away and partly in section, and illustrating the clamp in a first unclamped position for receiving workpieces to be clamped.

An actuating means for causing rotary movement of at least one of the gripping members (54 as illustrated) is provided and comprises a cam 78 positioned between the plates 24, 26 and eccentrically mounted to a camshaft 80 by press fitting, pining or other suitable means. Camshaft 80 has one end 82 (FIG. 4) positioned in an aperture 84 of the plate 26. The shaft also extends through an aperture 86 in the plate 24 and is thus rotatable. A lever arm 88 extends through a bore 90 of the camshaft 80 providing a finger grip for manually rotating the cam. Cam 78 which includes a rectilinear segment 91 (FIG. 3), is positioned adjacent to and in contact with gripping member 54 so that as the cam is rotated in contact with the member 54, it imparts rotary motion to the member 54 and gradually forces the member toward the stationery gripping member 52. A spring biasing means comprising a helical spring 92 is coupled at a location between the plates 24, 26 to the stand off 42 and a pin 94 mounted to the member 54. Spring 92 maintains the gripping member 54 in a retracted position as best seen in FIG. 2. After application of a force causing a rotary motion of the gripping member 54 (FIG. 3), the spring force will restore the member 54 to a retracted position when the rectilinear segment of the cam engages the gripping member.

Figure 6:
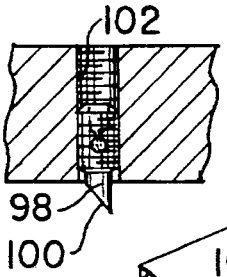
FIG. 6 is an enlarged, fragmentary view of a workpiece gripping pin of FIG. 3.

Mounted to and extending from each of the gripping members 52, 54 are a plurality of gripping bodies 98. As the gripping members 52, 54 experience relative rotation, a gripping body 98 which has a chisel edge 100 engages and penetrates the relatively softer wood trim edges and maintains the work pieces in place as gripping members 52, 54 clamp on to them. As best seen in FIG. 6, one form of gripping body 98 comprises a threaded cylindrical shaped body which is positioned in and engages an internally threaded bore 102 of the respective gripping member 52, 54. The chisel point 100 is formed integrally in the body 98. Body 98 also includes a hex shaped upper bore for receiving a hexagonal wrench, as for example an Allen wrench, for adjusting the position of the body within the bore 102 and the corresponding length of the extension of the gripping from a gripping member 52, 54.

Figure 7:
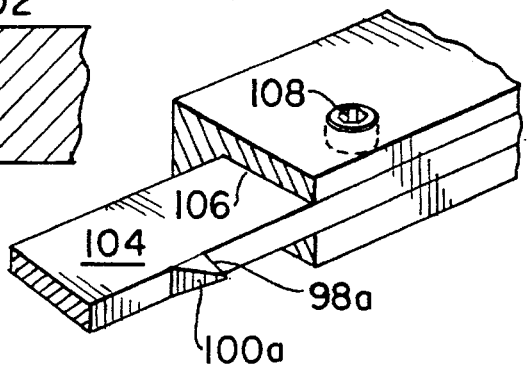
FIG. 7 is an enlarged fragmentary view illustrating an alternative embodiment of the workpiece gripping pin used with the clamp of FIG. 3.

FIG. 7 illustrates an alternative arrangement of the gripping body **98*a*. In FIG. 7, the gripping body comprises a chisel shaped segment 100*a* integrally formed in a bar 104 which bar is positioned in a slot 106 of the gripping member. A plurality of such chisel shaped gripping bodies (not shown) are formed along the length of the bar. Screws 108 secure the bar 104 in the slot 106**.

Figure 1:
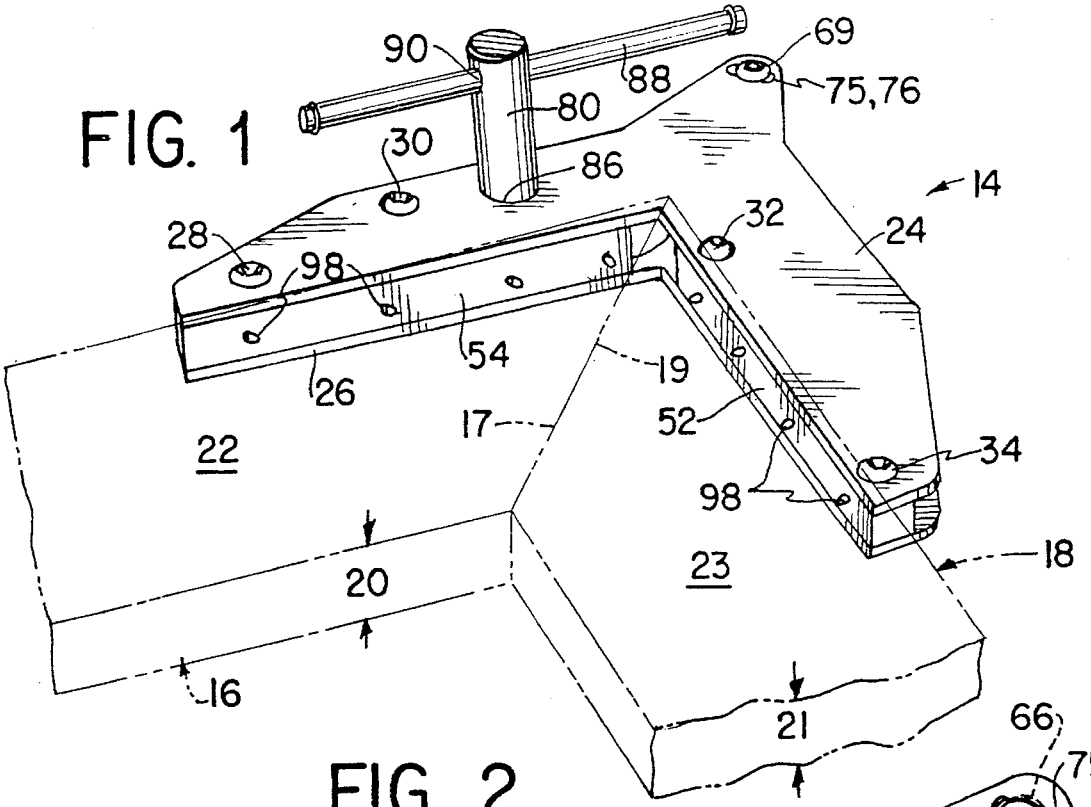
FIG. 1 is a perspective view of a miter clamp constructed in accordance with features of this invention.
Figure 3:
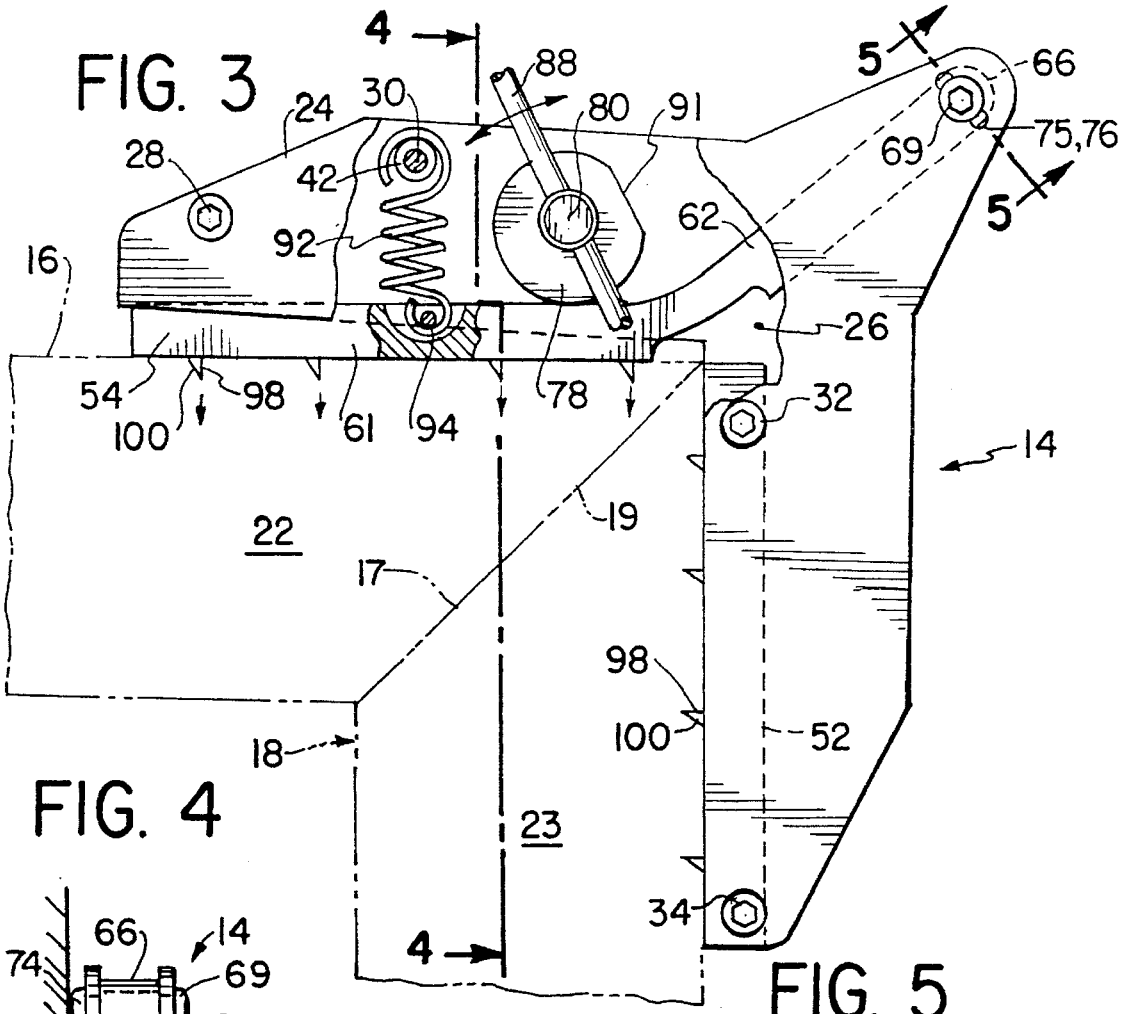
FIG. 3 is a top plan view of the miter clamp of FIG. 1, partly cut away and partly in section, and illustrating the clamp in a first clamped position for clamping workpieces.

In operation, the workpieces are positioned for installation, their miter joints are treated with a glue, the clamp is positioned for receiving the miter joints and the lever 88 is rotated thereby causing the cam 78 to contact and force the gripping member to rotate in a counterclockwise direction as viewed in FIGS. 1–3. The chisel points 100 of the gripping bodies 98, **98*a* engage the relatively softer workpiece and maintain it in position as the gripping force is increased by continued rotation of the lever arm 88**. Glue expelled at the miter joint during this operation can be removed and the application of force continued until the final force clamping level is attained.

Figure 8:
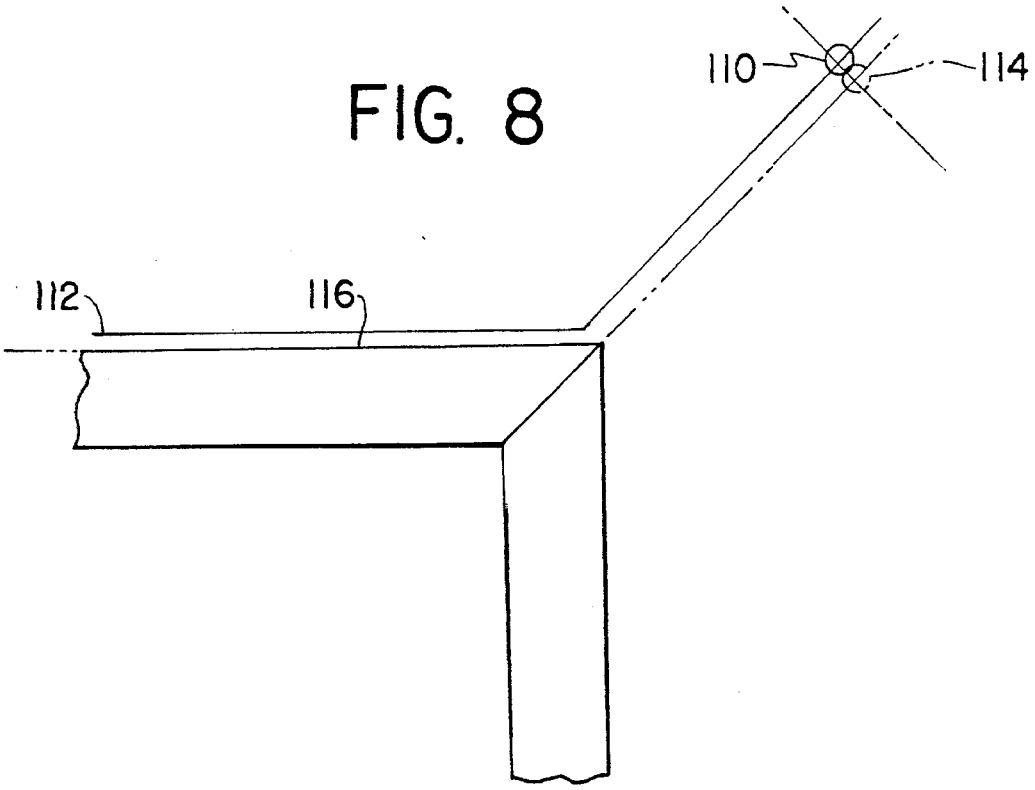
FIG. 8 is a schematic diagram illustrating the adjustment of a pivot means for accommodating workpieces of differing widths.

FIG. 8 illustrates the movement of the pivot point for workpieces of different widths. In FIG. 8, the width of the workpieces is smaller than that of the workpieces illustrated in FIGS. 1–3. The pivot point can then be moved from location 110 shown for larger width work pieces 112 to location 114 for smaller width workpieces 116. This is accomplished by loosening screws 69 and 74, moving the stand off 68 in the slots 75 and 76 to a desired position and retightening these screws.

Figure 9:
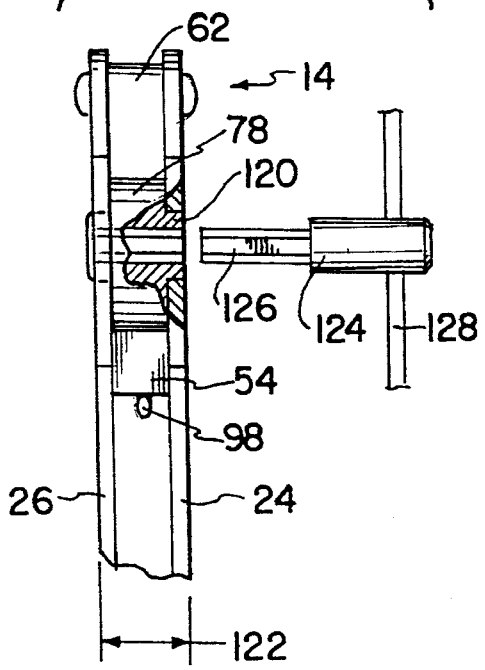
FIG. 9 is a fragmentary view, partly in section illustrating an alternative actuating means for the clamp of FIG. 3.
Figure 10:
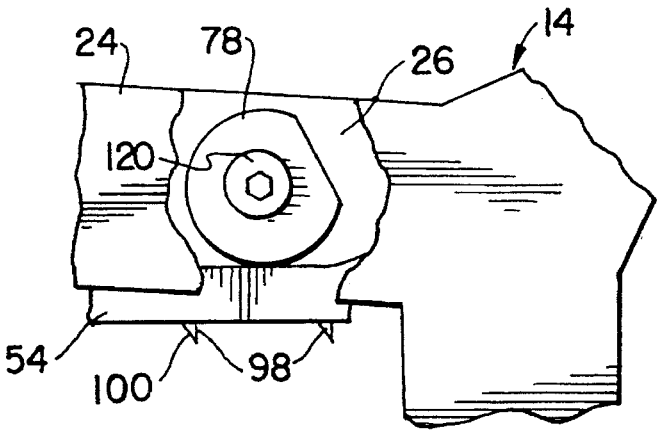
FIG. 10 is a fragmentary plan view, partly cut away, of the actuating means of FIG. 9.

FIGS. 9 and 10 illustrate an alternative embodiment of the clamp which facilitates stocking and storing of the clamp. A cam shaft 120 is shown to have a length approximately equal to the thickness 122 of the clamp. It includes a bore for receiving a demountable cam actuating key 124 having a similarly shaped and sized shaft 126. Key 124 includes a lever arm 128. The shaft is placed in position for use and is removed from the bore for storage.

An improved clamp has thus been described. While specific embodiments have been described, it will be apparent that variations made be made thereto without departing from the spirit of the invention and the scope of the appended claims.

What is claimed is:

1. A miter joint clamp assembly, comprising:

a. a first elongated clamp gripping member for engaging a first workpiece having a miter cut segment formed therein;

b. a second elongated clamp gripping member for engaging a second workpiece having a miter cut segment formed therein;

c. support means for mounting said first and second clamp gripping members in an assembly for receiving and maintaining the miter cut segments of said first and second workpieces in engagement between said clamp gripping members;

d. said support means comprising first and second spaced apart plates each extending parallel to a first plane and said clamp gripping members are mounted between said plates;

e. said first clamp gripping member rigidly mounted between said first and second plates and said second clamp gripping member is positioned for engaging said pivot means for rotary motion of said second member;

f. said support means including a pivot means for enabling rotary motion of at least one of said clamp gripping members relative to the other member in a direction parallel to said first plane;

g. an actuating means, including an actuating member extending transverse to said first plane for manually applying a rotary force to one of said clamp gripping members for causing rotary movement of said clamp gripping members toward each other and clamping engagement of said workpieces; and, h. said actuating means including a cam body rotably mounted between said first and second plates at a location for engaging and imparting rotary motion to said second clamp gripping member upon rotation of said cam.

2. The improved miter joint clamp assembly of claim 1 wherein said actuating member comprises a camshaft mounted to said cam and extending transversely to said plates.

3. The improved miter joint clamp assembly of claim 2 wherein said cam includes an aperture formed therein for receiving a remountable cam actuating key.

4. The improved miter joint clamp assembly of claim 1 wherein said second clamp gripping member includes a distal segment thereof and is pivotally mounted at said distal segment.

5. The improved miter joint clamp assembly of claim 4 including an aperture formed in said distal segment clamp gripping member and said pivot means includes a pivot body mounted to said first and second plates and extending through said aperture.

6. The improved miter joint clamp assembly of claim 3 including means for adjusting the location of said pivot body.

7. The improved miter joint clamp assembly of claim 4 including a spring biasing means for biasing said second clamp gripping member at a first location and said actuating means causes rotary motion thereof from said first location to a second location for engaging a workpiece.

8. The improved miter joint clamp assembly of claim 7 wherein said clamp gripping members each comprise an elongated bar having workpiece gripping bodies mounted therein and extending from said bar for engaging a workpiece.

9. The improved miter joint clamp assembly of claim 8 wherein said bar includes a bore formed therein and said workpiece gripping body is mounted in said bore and includes a segment thereof extending from said bore.

10. The improved miter joint clamp assembly of claim 9 wherein said gripping body includes a threaded outer surface in part, said bore in said bar is internally threaded and said threaded gripping body engages said threaded bore.

11. The improved miter joint clamp assembly of claim 8 wherein said gripping bodies are integrally formed with said bar.

12. A miter joint clamp gripping assembly, comprising:

a. a first elongated clamp gripping member for engaging a first workpiece having a miter cut segment formed therein;

b. a second elongated clamp gripping member for engaging a second workpiece having a miter cut segment formed therein;

c. support means for mounting said first and second clamp gripping members in an assembly for receiving and maintaining the miter cut segments of said first and second workpieces in engagement between said clamp gripping members;

d. said support means comprising first and second spaced apart plates each extending parallel to a first plane, said first and second clamp gripping members positioned between said plates;

e. said support means including means for fixedly mounting said first clamp gripping member in a retracted position between said plates and a pivot means for enabling rotary motion and extension of said second clamp gripping member in a direction parallel to said first plane from a retracted position between said plates upon application of an actuating force thereto; and, f. an actuating means, including an actuating member extending transverse to said first plane, for manually applying a rotary force and imparting rotary motion to said second clamp gripping member for causing rotary movement and extension thereof from a position between said plates toward said first clamp gripping member and damping engagement of said workpieces.

* * * * *